United States Patent [19]

Crowley

[11] 4,380,228

[45] Apr. 19, 1983

[54] SUSTAINED IGNITION SECONDARY COMBUSTION UNIT

[76] Inventor: Leslie B. Crowley, 3 Hamor Pl., Bar Harbor, Me. 04609

[21] Appl. No.: 256,036

[22] Filed: Apr. 21, 1981

[51] Int. Cl.[3] ..... F24B 5/00

[52] U.S. Cl. ..... 126/76; 126/77; 126/83; 126/103; 110/214

[58] Field of Search ..... 126/76, 77, 79, 103, 126/58, 60, 61, 69, 75, 65-67, 83; 110/315, 210, 211, 214

[56] References Cited

U.S. PATENT DOCUMENTS

| | | | |
|---|---|---|---|
| 225,208 | 3/1880 | Blanchard | 126/77 |
| 3,951,082 | 4/1976 | Leggett et al. | 110/211 |
| 4,182,304 | 1/1980 | Mele | 126/76 |
| 4,194,487 | 3/1980 | Cadwallader et al. | 126/76 X |
| 4,201,186 | 5/1980 | Paquin | 126/69 X |
| 4,291,669 | 9/1981 | Herne | 110/214 X |
| 4,363,785 | 12/1982 | Willson | 126/77 X |

*Primary Examiner*—Samuel Scott
*Assistant Examiner*—Margaret A. Focarino
*Attorney, Agent, or Firm*—Daniel H. Kane, Jr.

[57] ABSTRACT

A sustained ignition secondary combustion apparatus in a housing of refractory insulating material includes a first level for conducting secondary air through a secondary air inlet and channel, and a second level for conducting smoke products. A partition separates the levels or zones. Openings are provided in the partition between the levels bounded by a high temperature porous or fiberlike material in the form of igniter tube elements. Secondary air and smoke products diffuse into the interstices of the porous or fiberlike material where contact and combustion maintains the igniter tubes at or above the ignition temperature. Ignition and secondary combustion of smoke products in the second level is therefore sustained and secondary air is preheated as it passes through the openings. A secondary combustion zone is defined in the region of the openings between the levels and continues down stream through the exhaust outlet. The first and second levels of the secondary combustion unit may be arranged in a variety of configurations for preheating of secondary air and primary smoke by counterflow with high temperature end products of secondary combustion. Multiple or tortuous pathways may be provided for extended preheating. Primary smoke may also be preheated by smoke preheating tubes. The invention is also applied in a downdraft furnace.

32 Claims, 20 Drawing Figures

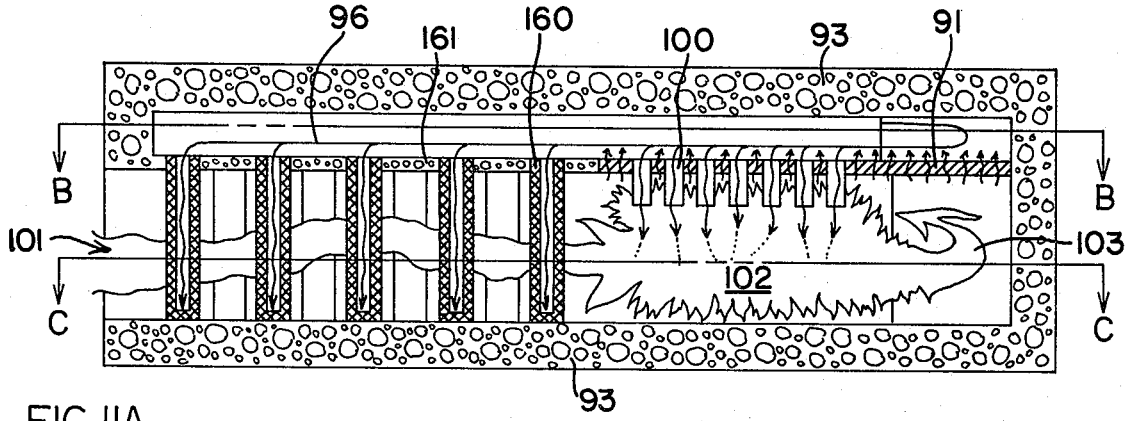
FIG IIA
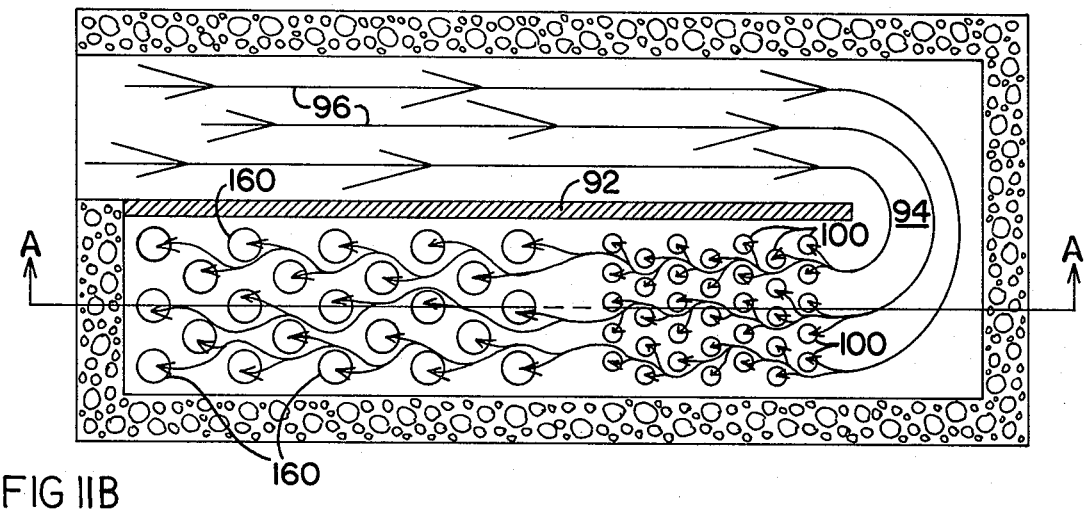
FIG IIB
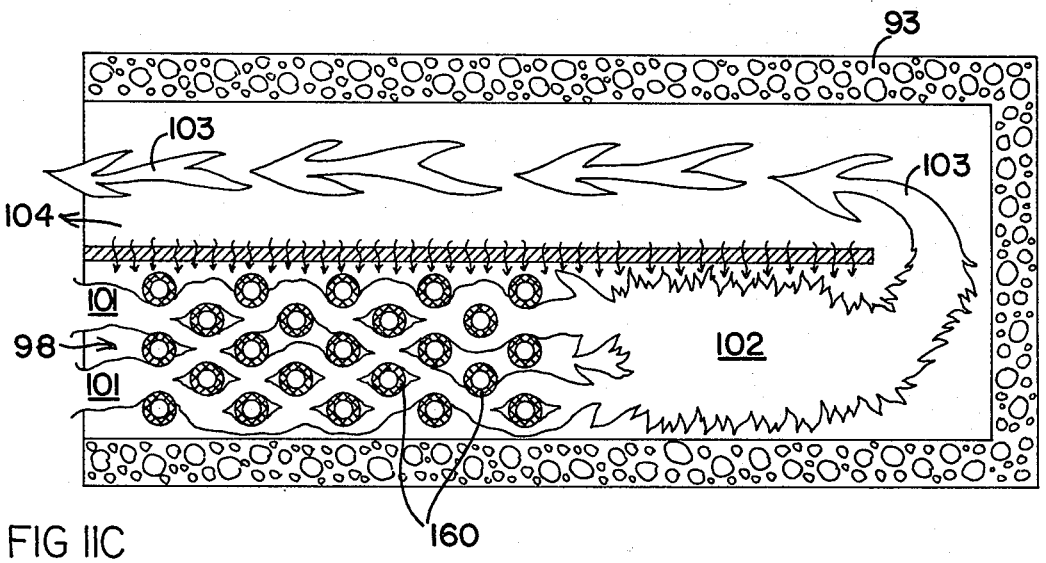
FIG IIC

SUSTAINED IGNITION SECONDARY COMBUSTION UNIT

BACKGROUND OF THE INVENTION

This invention relates to a new sustained ignition secondary combustion unit for the secondary combustion of smoke products from primary fuel burning, either as a built in or retrofitted component of a furnace or stove or as a self contained separate unit. The invention is particularly applicable for woodburning furnaces and stoves.

Efficient burning of wood fuel requires sufficient oxygen and maintenance of sustained high temperatures throughout the combustion zone. Conventional wood stoves and furnaces are generally inefficient because of the failure to maintain sufficient temperature for thorough oxidation & combustion of the volatile gases driven off by primary fuel burning. Even more recent wood stoves which seek to incorporate secondary combustion of the volatile gaseous products from primary wood burning are unable to mix enough secondary air for total combustion of the gases without cooling the mixture below the ignition point. As a result up to fifty percent of the energy content of the wood fuel escapes through the chimney in the form of these volatile gases. Thus, conventional wood stoves which operate at moderate domestic scale outputs suffer from inefficient combustion because of either insufficient temperature or insufficient secondary air.

Furthermore, it is important that the functions of primary wood fuel burning and secondary combustion of volatile gases be handled sequentially. Preferably this is accomplished by at least partially separated primary and secondary combustion chambers. Conventional wood stoves with a single combustion chamber which admit more air intending to increase efficiency merely burn the wood faster increasing the primary wood fuel burning rate. This may not necessarily increase the combustion of volatile gases driven off by the primary burn. Thus, without a secondary combustion chamber efficient and complete combustion is difficult to attain without burning the wood fuel at an excessive rate. Where a secondary combustion chamber is added such prior art wood stoves or furnaces suffer the defect of insufficient temperature or insufficient secondary air as discussed above.

OBJECTS OF THE INVENTION

It is therefore an object of the present invention to provide a sustained ignition secondary combustion unit which establishes a secondary combustion zone downstream from the primary fuel burning in which a temperature is maintained above the ignition point of the gaseous products of primary fuel burning yet with sufficient secondary air for effectively complete secondary combustion. A feature and advantage of the invention is that it may be incorporated as an integral portion of a furnace, retrofitted as a component of existing furnaces or stoves, or used as a self contained separate unit.

Another object of the invention is to provide a secondary combustion unit in which secondary air entering the secondary combustion zone may be preheated by heat exchange with either the primary combustion zone, the secondary combustion zone or both. The smoke products of primary combustion may also be preheated by heat exchange with the secondary combustion zone or smoke preheating tubes prior to entry into the secondary combustion zone.

It is also an object of the invention to provide a secondary combustion zone and unit with high temperature ignition elements which maintain a glowing state above the ignition temperature of the volatile flue gas products for sustained ignition and secondary combustion.

The invention also contemplates a variety of configurations for achieving sustained ignition, secondary combustion, and preheating of secondary air and primary combustion smoke products.

SUMMARY OF THE INVENTION

In order to accomplish these results the invention provides a sustained ignition secondary combustion apparatus and arrangement in a housing of refractory insulating material including a first level for conducting secondary air through a secondary air inlet and channel, and a second level for conducting smoke products from primary fuel burning through a smoke products inlet and channel, secondary combustion zone, and exhaust outlet. The partition separating the levels or zones comprises a high temperature material which may be either heat conducting for heat exchange and preheating or heat insulating.

According to the invention openings are provided in the partition between the levels bounded by a high temperature porous or fiberlike material having surface area portions contacting the secondary air from the first level on one side and smoke products from the second level on the other side. Infiltration or diffusion into the interstices of the porous or fiberlike material results in contact and combustion of the secondary air and smoke products and maintains the refractory porous or fiberlike material around the openings at or above the ignition temperature. The material thus sustains ignition and secondary combustion of smoke products in the second level as preheated secondary air passes through the openings from the first level into the second level. A secondary combustion zone is thus defined in the region of the openings between the levels and continues down stream through the exhaust outlet in the area bounded by refractory insulating material.

The first and second levels of the secondary combustion unit may be arranged in a variety of configurations for counterflow of secondary air on one side and high temperature products of secondary combustion on the other side. If the separating partitions are heat conducting, heat exchange and preheating of the secondary air results. Multiple or tortuous pathways may be provided for extended preheating of secondary air. Furthermore the configuration of pathways across the partition may also be arranged for preheating smoke products of primary combustion before entering the secondary combustion zone. Furthermore, glowing hot smoke preheating tubes may also be used to preheat these smoke products prior to entering the secondary combustion zone.

According to the preferred embodiment the openings between the levels comprise tube elements defining passageways extending between the levels. The tube elements are comprised of a high temperature porous or fiberlike material extending into the secondary combustion zone. For example, a ceramic fiber material such as "Kaowool" paper may be used and rolled into tubes with the free ends interlocked.

The tube elements may also be arranged in a variety of configurations and may comprise tube elements of different dimensions. Thus for example, tube elements upstream in the direction of travel of the smoke products may be of relatively smaller diameter and longer length for initial contact with the smoke products while the tube elements downstream in the direction of travel may be of relatively larger diameter and shorter length. The sustained ignition refractory porous igniter tubes may be arranged in groups for secondary combustion or preheating at upstream and downstream locations in the flue gas path. The invention also contemplates an after chamber or channel of insulated refractory material for continuing the secondary combustion to substantial completion following the igniter tube secondary combustion zone.

According to a further aspect of the invention the sustained ignition secondary combustion apparatus is incorporated as an integral portion of a wood furnace or stove such as a down draft wood furnace or stove. With the secondary combustion unit arranged below the primary combustion fire box and grate the secondary air channel and secondary air may also be preheated by heat of the primary combustion coals. In operating the secondary combustion unit a wood fuel fire is started in the primary combustion chamber operating as an updraft furnace and a hot bed of coals is established. Dampers are adjusted for down draft through the secondary combustion unit and the igniter tubes are fired. Thereafter, the secondary combustion ignition temperature is maintained in the refractory porous or fiberlike material of the igniter tubes with sustained ignition of secondary combustion in the secondary combustion zone.

Other objects, features and advantages of the present invention will become apparent in the following specification and accompanying drawings.

BRIEF DESCRIPTION OF THE DRAWINGS

FIG. 11A is a side cross section of a modified single return sustained ignition secondary combustion unit provided with smoke preheating tubes extending entirely across the smoke channel upstream from the secondary air igniter tubes and viewed in the direction of the arrows on line A—A of FIG. 11B.

FIG. 11B is a top cross section through the secondary air channel and FIG. 11C is a top cross section through the flue gas or smoke channel, of the modified single return sustained ignition secondary combustion unit viewed in the direction of the arrows on the respective lettered lines of FIG. 11A.

DESCRIPTION OF THE PREFERRED EXAMPLE EMBODIMENTS AND BEST MODE OF THE INVENTION

Figure 1:
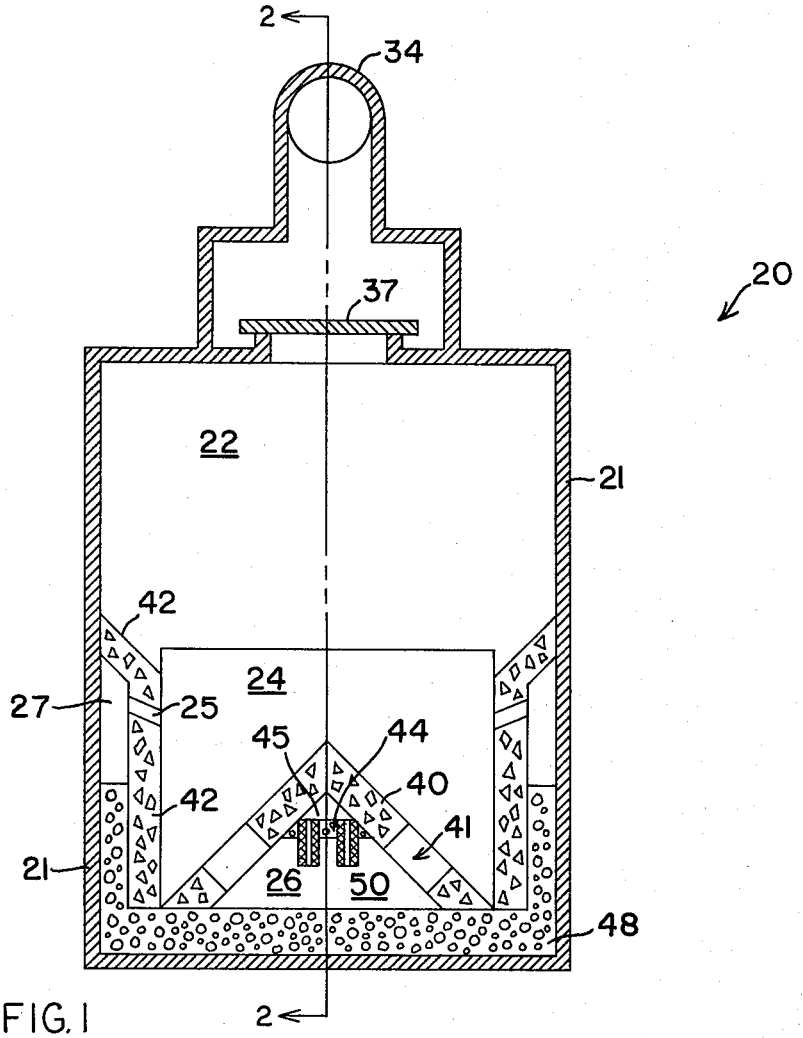
FIG. 1 is a front cross section of a furnace in accordance with the present invention viewed in the direction of the arrows on line 1—1 of FIG. 2.
Figure 2:
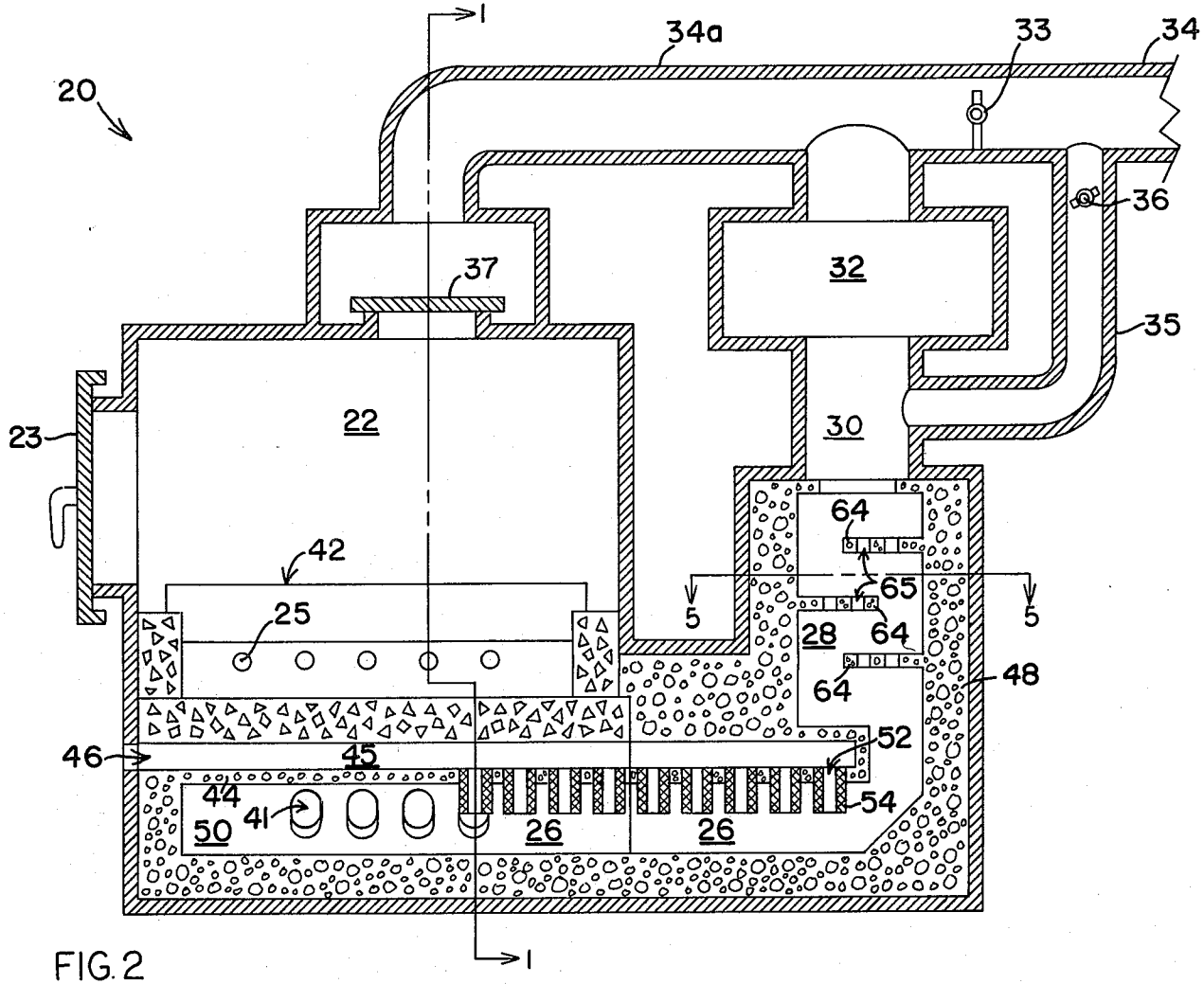
FIG. 2 is a side cross section of the furnace viewed in the direction of the arrows on the line 2—2 of FIG. 1.

A down draft furnace incorporating the elements of the present invention is illustrated in FIGS. 1-5. Referring particularly to FIGS. 1 & 2 the furnace 20 includes a metal housing or casing 21 enclosing a wood fuel loading area 22, primary combustion zone 24, secondary combustion zone 26,and after chamber 28. Access to the wood loading area 22 is obtained through air tight door 23. The end products of combustion in after chamber 28 which have followed the down draft pathway hereafter described, exit through flue outlet 30 and heat exchanger 32 to the chimney flue coupling 34 controlled by partially closing damper 33. Flue pipe 35 controlled by damper 36 affords a bypass around heat exchanger 32. The extension 34A of chimney coupling flue passageway 34 connects to the top of the fuel loading zone 22 and combustion chamber 24 to permit bypassng the down draft pathway when the cover 37 is removed during startup as hereafter described.

Referring in more detail to the elements of the present invention incorporated in the furnace, the primary combustion chamber or zone 24 is provided with a grate 40 for supporting the burning wood fuel during primary combustion. The grate 40 includes down draft holes 41 and may be cast for example from structural refractory cement such as Kaiser "Furnacecrete Super" refractory cement. The primary combustion zone 24 is also provided with refractory cement liners 42 at the ends and at each side. The primary combustion zone or chamber 24 is therefore entirely lined at its sides, ends and base of refractory structural cast components.

As shown in the examples of FIGS. 1 & 2 the grate 40 has a cross sectional configuration in the shape of an upside down V and extends longitudinally from the front to the back of the primary combustion chamber. More generally, tbe grate 40 is in a concave downward configuration defining below it a space extending from front to back below the primary combustion zone. The space below the grate 40 is fitted with a refractory divider 44 which can be made either of a heat insulating or heat conducting material. Typically, the divider or plane 44 may be made of a refractory material such as Kaowool "M" board $\frac{1}{4}$-$\frac{1}{2}$ inch thick manufactured by Babcock and Wilcox. The divider 44 divides the space below grate 40 into two channels or passageways, an upper secondary air channel 45 and a lower flue gas or smoke passageway 50. The secondary air channel 45 and flue gas or smoke channel 50 extend substantially the length of the furnace from front to back in the region below the primary combustion chamber. The secondary air channel is sealed from the primary combustion chamber and grate.

Smoke enters the forward end of the smoke passageway or channel 50 through down draft holes 41 formed in the grate 40. Secondary air for complete secondary combustion of the flue gas enters through a damper or draft opening 46 at the front of the furnace. Primary combustion air in the primary combustion zone is provided through openings 25 in the liners of the primary combustion chamber leading to a primary air channel 27 at the sides of the furnace. The entire bottom or base of the furnace within metal casing 21 is provided with a refractory base or liner of cast refractory cement 48.

The gaseous products of primary combustion are drawn downward through holes 41 in the grate 40 to the lower level or smoke channel 50 then pass in the direction of the rear of the furnace through the lower level or channel. The draft is established by the chimney through chimney coupling 34 outlet 30 and after chamber or after burner 28. Thus, the down draft is normally established and maintained by the natural draft of the chimney however this could be enhanced by a chimney or flue blower for artificially enhancing the draft. The draft established through outlet 30 also draws secondary air in through the opening 46 at the front of the furnace to the upper level or secondary air level or channel 45 as a result of openings formed in the divider 44 between the levels or channels toward the rear of the furnace. As shown in FIGS. 1 & 2 the openings 52 are defined and lined with tube elements 54 of a special character.

According to the invention a multiplicity of openings 52 and tube elements 54 are formed in the separator or divider 44 which separates the secondary air channel 45 from the flue gas smoke channel 50. The tube elements 54 extend into the smoke channel 50 and are made of a porous or fiberlike material. In a preferred form of the invention the tube elements comprise a ceramic fiber material or paper such as "Kaowool paper" manufactured by Babcock and Wilcox. The tube elements may be formed by rolling pieces of ceramic fiber paper into cylindrical or tubular elements which may be for example $\frac{3}{8}$ inch in diameter and extend as much as an inch and a half into the flue gas smoke channel 50. The plurality of tube elements 54 extending from the opening 52 into the smoke channel define the secondary combustion zone 26 for the reasons hereafter setforth.

According to the invention a fire is started in the furnace with paper, kindling wood, and fire wood properly set into the fire box resting on the grate 44. The bypass damper or cover 37 is open to permit the furnace to burn initially as a strong updraft furnace. Primary air dampers are open to admit primary air through channels 27 and openings 25 adjacent the fuel. A secondary damper controlling the secondary air inlet opening 46 is also opened. The paper is ignited starting the fire and the fire is allowed to burn briskly as a conventional updraft furnace. After approximately one to two hours a good bed of hot charcoal is formed on the grate of the furnace and the fire is still flaming briskly. With a good bed of hot charcoal formed the bypass damper or cover 37 is closed so that the hot smoke and flames from primary combustion travel down through the bed of hot coals through the grate slots or openings 41 and into the smoke channel 50. The down drafting flames contact and heat the tube elements 54 extending into the flue gas smoke channel and in a short time for example a few seconds the tubes are heated to a glowing hot state.

A feature and characteristic of the tubes 54 according to the present invention is that they are made of a refractory fibrous, felt, or porous material for infiltration of smoke and secondary air into the walls of the tube elements. Thus, secondary air drawn through the secondary channel 45 and the openings 52 by the chimney draft pass through and contact the insides of the walls of the tube elements 54 at the same time that the tube walls are contacted at the outside by smoke products from primary combustion. Still heated by initial flame contact, secondary air and smoke products diffusing into the porous or fiberlike material are ignited in secondary combustion thereby sustaining the ignition temperature or glowing state of the portions of the tube elements 54 extending into the smoke channel.

Secondary air passing through the tube elements 54 is therefore preheated to temperatures in the vicinity of the ignition temperatures of the flue gas products. Secondary combustion of the flue gases is therefore sustained in the region below the tube elements in the vicinity of the tube elements referred to herein as the secondary combustion zone.

Thus, an updraft primary combustion is first established in order to develop a bed of flaming hot coals. The dampers are then manipulated so that down drafting flames initially heat the tube elements to secondary combustion ignition temperatures. Secondary air drawn through the tube elements through the upper level or channel 45 is therefore preheated for sustaining secondary combustion in the secondary combustion zone in the vicinity of the projecting tube elements. Because of the porous or fibrous character of the material of the tubular element walls, migration, infiltration or diffusion of secondary air and smoke products takes place within the tubular element walls where ignition takes place assuring that the tubular elements remain in a glowing state, at secondary ignition combustion temperatures or greater. Thus, once the secondary combustion is "turned on" the tubular elements maintain sufficient temperature and sufficient preheating of the secondary air to assure that secondary ignition is sustained. And this is achieved by diffusion of secondary air and smoke products within the inner interstices of the wall material itself as shown in more detail in FIGS. 3 and 4.

Figure 3:
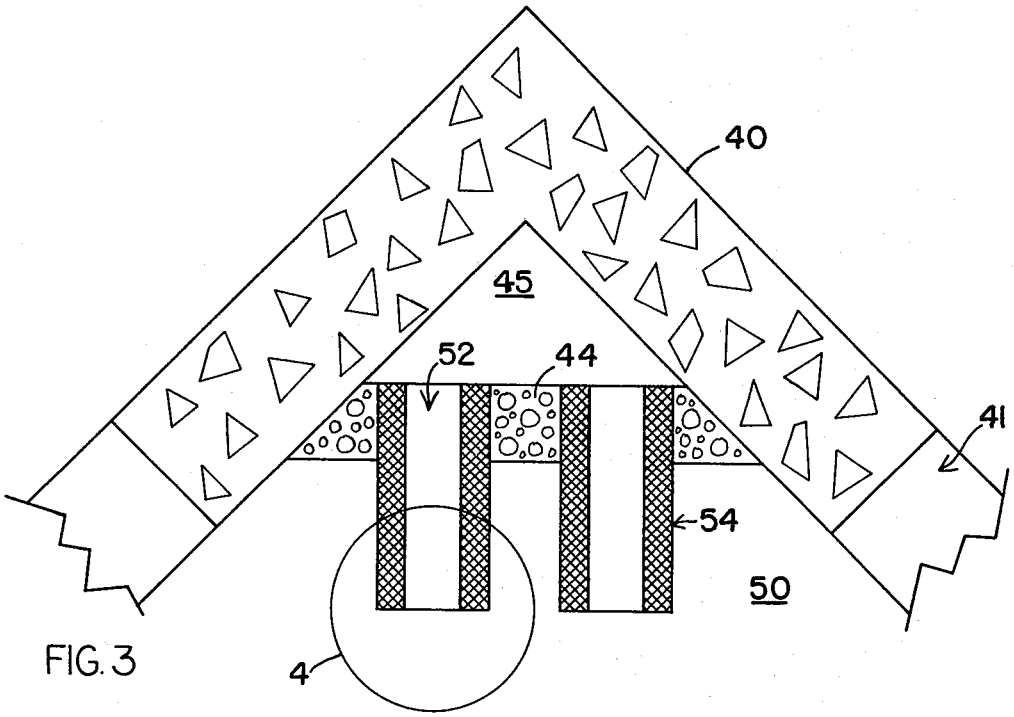
FIG. 3 is a detailed front section through a portion of the top of the grate of the furnace showing the secondary air inlet channel and igniter tubes supported in the channel divider.
Figure 4:
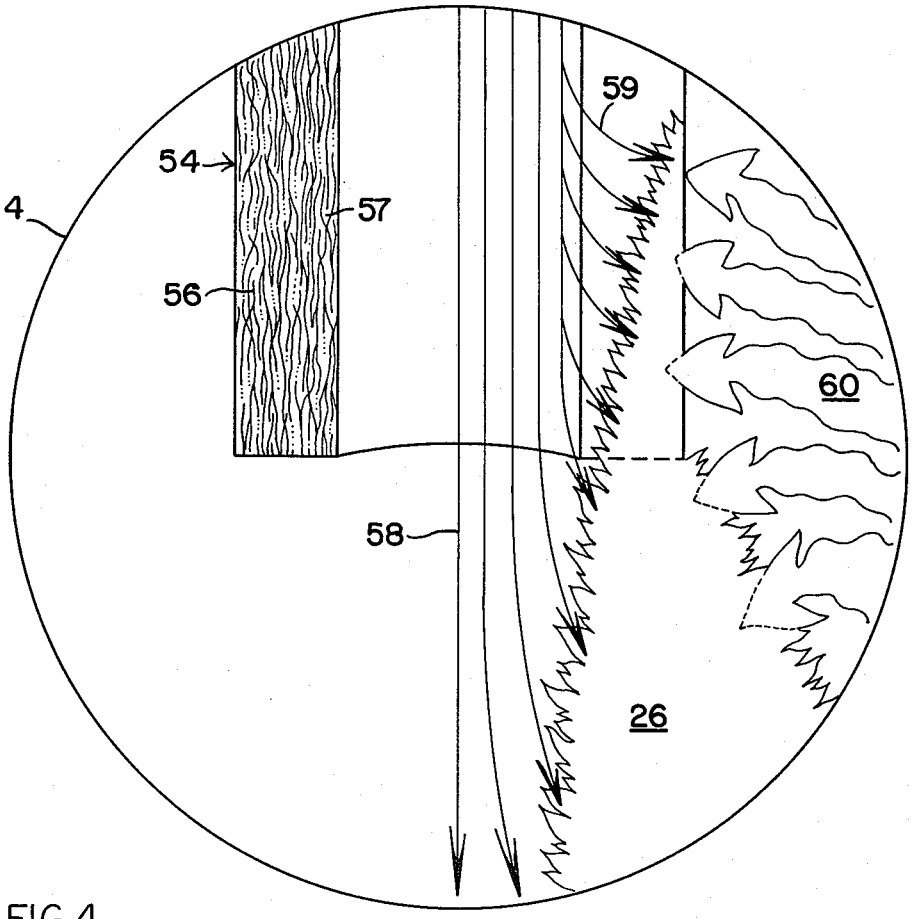
FIG. 4 is a detail of a portion of FIG. 3 contained in the circle 4 of FIG. 3 showing an igniter tube of ceramic refractory fiber material.

As shown in FIGS. 3 and 4 the tubular elements 54 which line the opening 52 and divider or separator 44 are made of a fibrous material such as the ceramic fiber or felt paper, Kaowool paper. In the preferred form, the wall of tubular element 54 thus comprises a network of fibers 56 and interstices or inter spaces 57. Other refractory porous or fibrous material may also be used. Secondary air 58 drawn downward by the chimney draft through the opening 52 from secondary air channel 45 into the smoke channel 50 partially migrates into the interstices of the ceramic fiber wall as shown by arrows 59. On the other hand at the outside of the tubular element walls smoke products from primary combustion 60 similarly penetrate into the interstices and upon contact with the secondary air secondary combustion occurs within the walls of the tubular element itself maintaining the tubular element in a glowing state and at temperatures above the ignition temperatures of the flue gasous products. Preheated secondary air 58 encounters the smoke and gaseous products 60 in the vicinity of the tubular elements defining a secondary combustion zone 26 in which secondary combustion is sustained through to substantial completion.

According to the concept of the present invention a multiplicity of openings 52 and tubular elements 54 defining the elongate preheating channels are provided for distributing the incoming secondary air into a multiplicity of narrow jets. By this expedient the secondary air can be more efficiently preheated and more efficiently distributed for contacting the primary combustion smoke products and completely burning them. To this end a number of variations in the dimensions, geometry, and distribution of the tubular elements is possible.

According to a preferred form of the invention different size igniter tubes 54 are distributed over the divider 44. For example upstream tubular elements or igniter tubes 54 that is tube elements which make initial contact with the smoke are longer and narrower to permit better heating of secondary air within the tube itself. This maintains ignition in the tube in marginal areas. For example the longer and narrower tubes are distributed in the upstream portions and along the sides of the divider 44. Typical dimensions for such tubular elements would be for example one and a third inches to one and a half inches in length and five sixteenths inches in diameter while larger tube elements in the downstream region and central portions of the divider may be for example one inch to one and one quarter inches in length and three eighth inches in diameter. A suitable Kaowool paper or ceramic fiber paper for forming the tubular elements is one sixteenth of an inch thick and rolled with freely opened ends interlocked. The tubular elements may be fitted into holes in a half inch thick "M" board partition also manufactured by Babcock and Wilcox. The partition may also be made of a heat conducting material such as metal, for heat exchange. By this expedient secondary combustion may be sustained in the secondary combustion zone because of the ignition temperature maintained in the walls of the tubular elements themselves.

Figure 5:
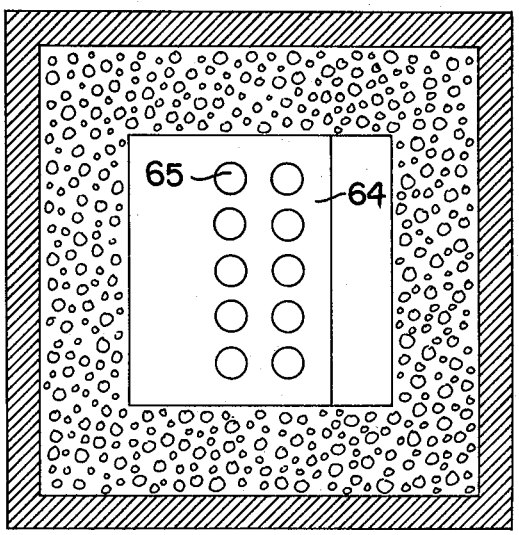
FIG. 5 is a partial section of the after chamber of the furnace viewed in the direction of the arrows of line 5—5 of FIG. 2.

The end products of combustion pass through the after chamber 28 of furnace 20 shown in more detail in the cross section of FIG. 5. The after chamber portion 28 of furnace 20 is included within the metal casing or housing 21 and is lined with refractory cement such as cast "V" block cement 48. The after chamber 28 comprises a vertical column transformed into a tortuous pathway within the refractory lining material by baffles 64 extending alternatively into the after chamber's face. The baffles include holes or openings 65 and generally introduce turbulence and motional flow into the flue gas received from secondary combustion zone 26. This turbulence and motional flow assures complete mixing and exposure of the end products of combustion in the high temperature environment further assuring high efficiency and completion of the combustion. The high temperatures established in secondary combustion zone 26, temperatures above the ignition temperatures of the constituents and components of primary fuel combustion, is prolonged through the afterchamber with turbulent mixing for added efficiency before passage through the heat exchanger 32.

Figure 6A:
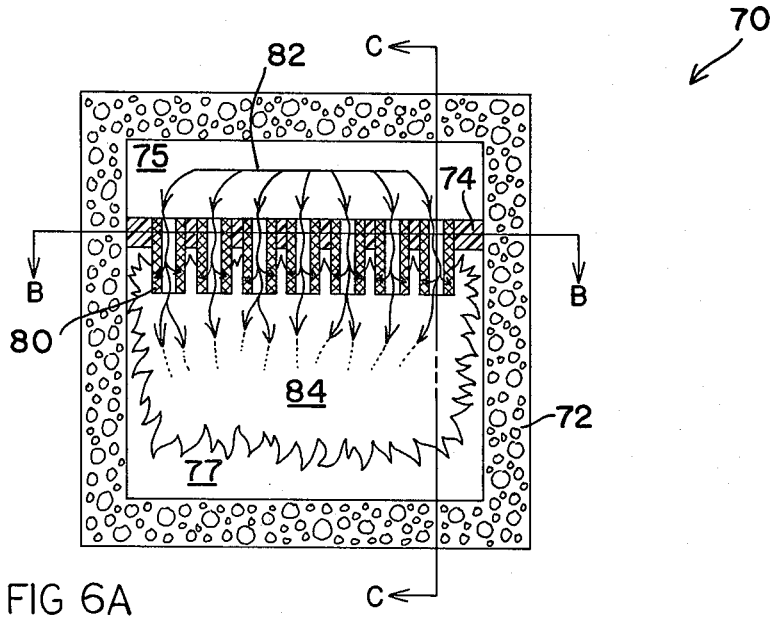
FIG. 6A is a front cross section of a single exhaust pass through sustained ignition secondary combustion unit in accordance with the present invention viewed in the direction of the arrows on line A—A of FIG. 6B.
Figure 6B:
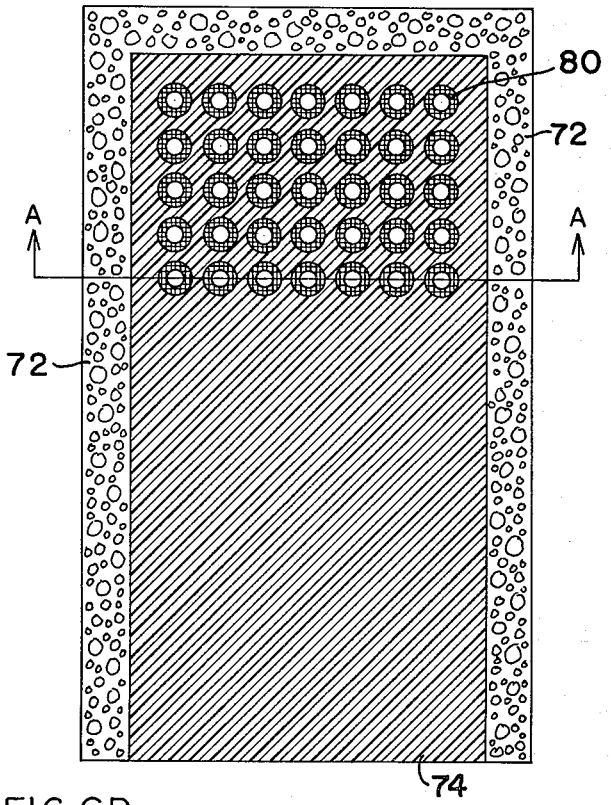
FIG. 6B is a top cross section of the single pass sustained ignition secondary combustion unit viewed in the direction of the arrows on line B—B of FIG. 6A.
Figure 6C:
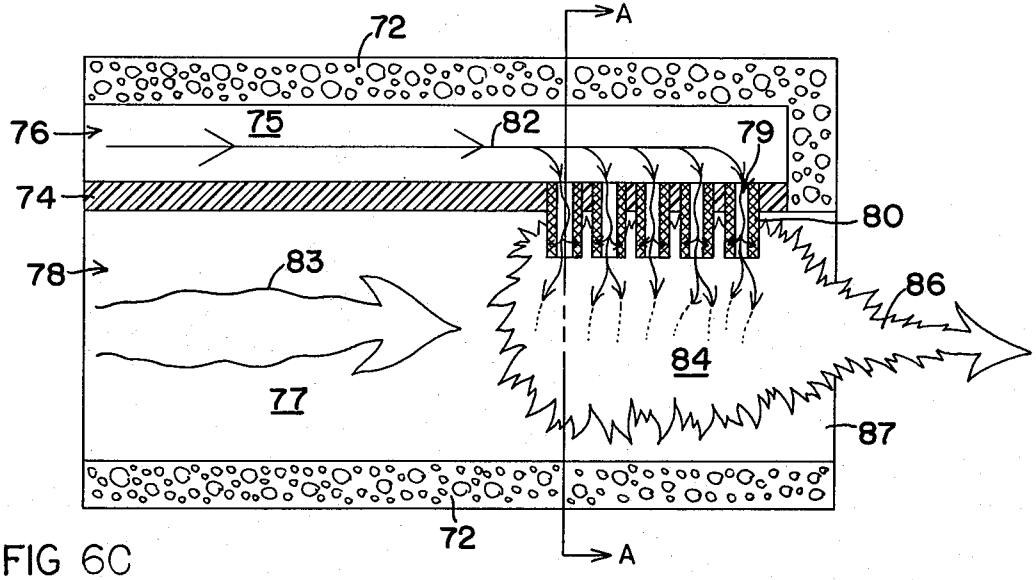
FIG. 6C is a top cross section of the single pass sustained ignition secondary combustion unit viewed in the direction of the arrows on line C—C of FIG. 6A.
Figure 7B:
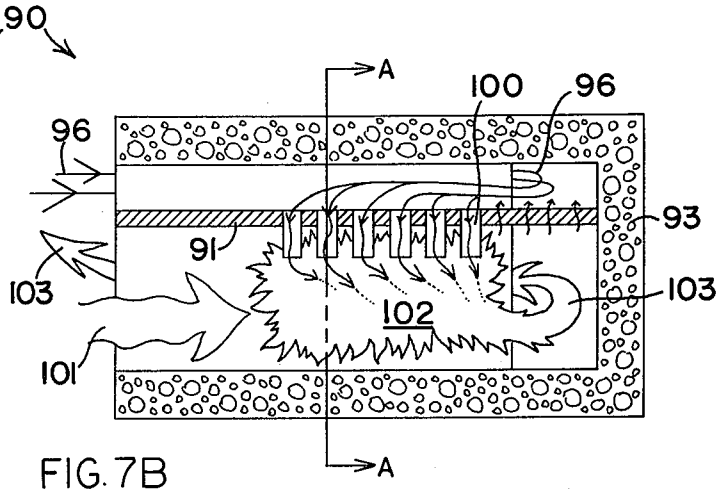
FIG. 7B is a side cross section.
Figure 7A:
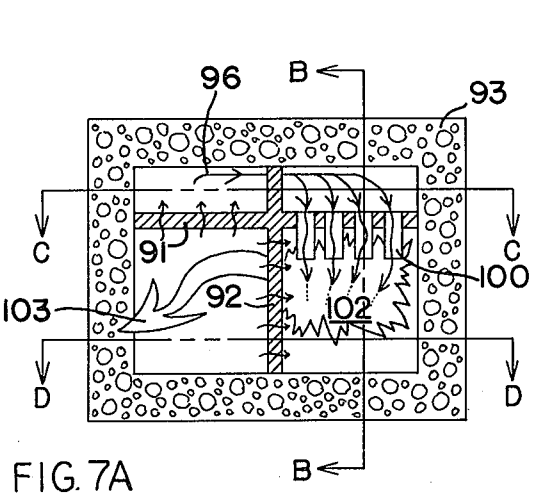
FIG. 7A is a front cross section of a single exhaust return thermal heat exchange sustained ignition secondary combustion unit in accordance with the invention viewed in the direction of the arrows on line A—A of FIG. 7B.
Figure 7D:
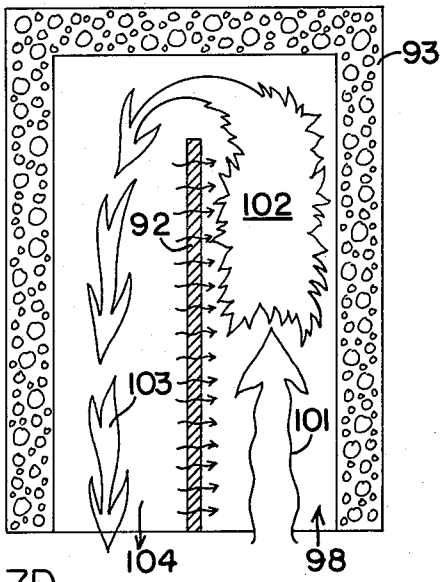
FIG. 7D is a top cross section through the flue gas smoke channel and secondary combustion chamber, of the single return thermal heat exchange sustained ignition secondary combustion unit viewed in the direction of the arrows on the respective lettered lines of FIG. 7A.
Figure 7C:
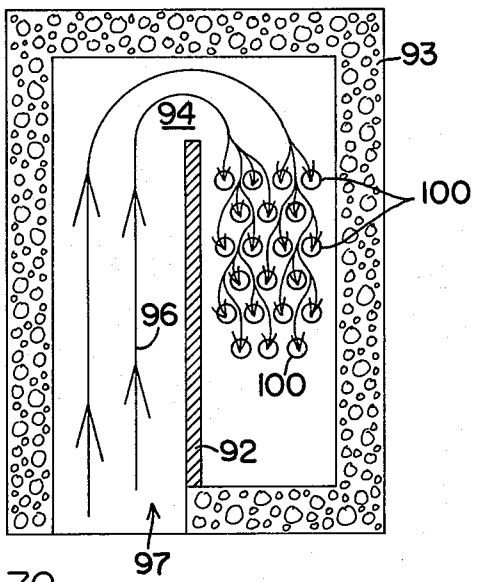
FIG. 7C is a top cross section through the secondary air channel.

The elements of the present invention have been shown in the example embodiment of FIGS. 1–5 with reference to a down draft furnace in which the invention is incorporated. More generally however the invention comprises a sustained ignition secondary combustion unit which may be retrofitted into existing furnaces or provide a separate component or unit for use in association with existing furnaces and primary combustion chambers. Another embodiment of the present invention of more general application is therefore illustrated in FIGS. 6A through 6C. In this embodiment the sustained ignition secondary combustion unit 70 comprises a housing 72 of insulating refractory material such as cast "V" block refractory cement mix. The housing 72 encloses an inner space or chamber divided into two channels or levels by the divider 74 which extends across the length and width of the housing. The upper level or channel in the embodiments of FIGS. 6A through 6C constitutes the secondary air channel 75 while the lower level or channel comprises the smoke channel or gaseous flue products channel 77. The secondary combustion unit is formed with an inlet end where secondary air is received through the opening 76 from the secondary air inlet of the furnace or other application with which the unit is combined. Similarly the smoke or gaseous products from primary combustion are received through the opening 78 coupled to the primary combustion chamber of the furnace or other application in which the unit is combined.

The divider 74 is formed with openings as heretofore described for passage of secondary air from the secondary air channel to the smoke channel. These openings 79 are defined as heretofore described by refractory porous or fibrous material which extends into the gaseous flue products channel 77. The tubular elements 80 or igniter tubes 80 are comprised of a porous or fibrous material and function in the matter heretofore described. Thus, secondary air 82 passing through the upper level or channel 75 are drawn through the opening 79 and infiltrate into the interstices of the walls of the tubular elements 80 where contact is made with smoke or gaseous products infiltrating similarly from the outside wall. Ignition within the interstices or interspaces maintains ignition temperatures and a glowing state in the walls of the tubular elements for effectively preheating the secondary air. A secondary combustion zone 84 is therefore maintained in the vicinity of the tubular elements where they project into the smoke channel 77. The end products of secondary combustion 86 exit through opening 87 at the end of the secondary combustion unit coupled through flue coupling elements to the chimney. Thus the chimney draft establishes the direction of flow drawing the secondary air preheated by tubular elements 80 and the smoke products 83 into the secondary combustion zone 84 then finally delivering the efficient end products of combustion 86 to the chimney.

The dividing plane for separating plane 74 may be formed from a refractory material either insulating or conducting. Thus the divider 74 may be formed of metal permitting efficient heat transfer from the flames and smoke products 83 from primary combustion to the secondary air 75 admitted through opening 76. On the other hand, the divider 74 may be formed of a refractory insulating material such as Kaowool "M" board thereby retarding heat transfer between the channels or levels. In the latter event the preheating of the secondary air is achieved primarily by the tubular elements or igniter tubes 80.

For some effective preheating of the secondary air prior to entry into the igniter tubes 80 a more complex sustained ignition secondary combustion unit may be devised or arranged as shown in the example embodiment of FIGS. 7A through 7D. According to the embodiment of FIGS. 6A through 6C the smoke products and secondary air make a single pass through the secondary combustion unit, the secondary air joining the smoke in the secondary combustion zone after passing through igniter tubes 80. According to the embodiments of FIGS. 7A through 7D additional heat exchange is provided between the smoke and secondary air upstream from the secondary combustion zone by means of a double pass or single turn configuration within the unit.

As shown in the FIGS. 7A through 7D the secondary combustion unit 90 is formed not only with horizontal divider 91 but also a vertical divider 92 extending the height of the housing and nearly the entire length however leaving an opening 94 at the end for return of the secondary air and hot flue gas in the respective upper and lower levels. In the upper level or secondary air channel the secondary air 96 passes down along the horizontal and vertical divider walls 91 and 92 where heat is exchanged to the secondary air from end products of secondary combustion passing below. According to the invention secondary air enters through an opening 97 at the left hand side of the upper level. On the other hand the smoke products of primary combustion enter through opening 98 in the right hand side of the lower level or channel. The secondary air and smoke products are therefore effectively in counterflow across the dividing walls and surfaces. When the secondary air 96 passes through the igniter tubes 100 which function in the manner heretofore described a secondary combustion zone 102 is established in the lower level where the high secondary combustion temperatures are sustained. The hot end products 103 of nearly complete combustion are returned back around wall 92 to the chimney flue outlet 104 along a path which is in heat exchange relationship with the incoming secondary air entering at inlet 97 of the upper level or channel. If wall divider 91 is therefore comprised of a heat transfer material, preheating of secondary air results.

Thus the sustained ignition secondary combustion unit 90 of FIG. 7A through 7D provides heat exchange from the hot end products of nearly complete secondary combustion to the incoming secondary air across a heat transfer divider. Furthermore heat is transferred from the relatively hotter products of secondary combustion to the incoming primary combustion smoke across the vertical heat transfer wall 92. By this expedient of a single return, efficient heat exchange and combustion can be established.

Figure 8A:
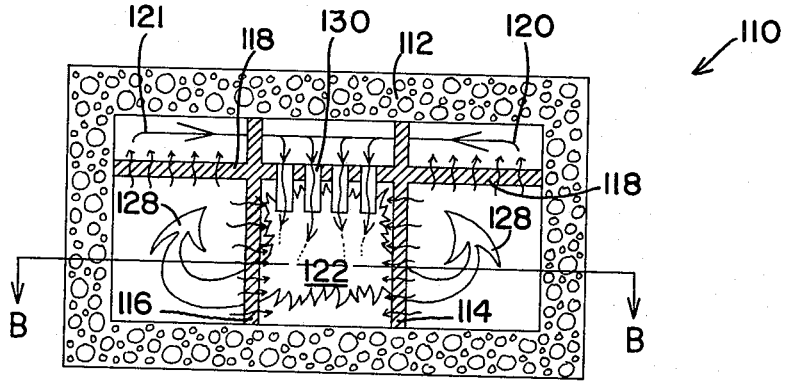
FIG. 8A is a front cross section of a double exhaust return secondary air preheating sustained ignition secondary combustion unit in accordance with the invention viewed in the direction of the arrows on line A—A of FIG. 8B.
Figure 8B:
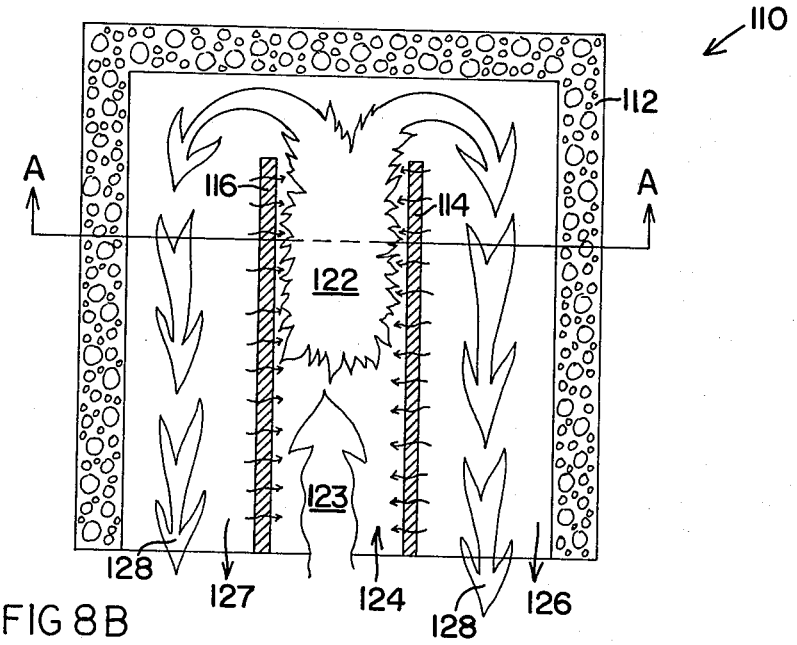
FIG. 8B is a top cross section of the double return sustained ignition secondary combustion unit viewed in the direction of the arrows on line B—B of FIG. 8A.

Yet another variation of the sustained ignition secondary combustion unit providing double return is illustrated in FIGS. 8A and 8B. According to this arrangement the secondary combustion unit 110 is comprised of a housing of refractory insulating material 112 in which two vertical separating or divider walls 114 and 116 are provided intersecting the horizontal divider 118. According to the invention secondary air enters in the two outer channels 120 and 121 for return around the ends of vertical dividers 114 and 116 to enter the igniter tubes 130 passing downward into a secondary combustion zone 122. On the other hand smoke products 123 of primary combustion enter through the central opening 124 in the lower level and pass into the secondary combustion zone 122 from which the end products of secondary combustion divide passing around the vertical walls 116 and 114 respectively and then passing along the outer channels defined at the lower level to the outlets 126 and 127 leading to the chimney and established draft.

By this double return arrangement, heat exchange occurs in the vertical direction from the end products 128 of secondary combustion across the horizontal divider 118 to the incoming secondary air in upper channels 121 and 120. The secondary air is thus preheated by the hotter temperature of secondary combustion before passing through the igniter tubes 130 into the secondary combustion zone 122. Additionally, the end products 128 of secondary combustion passing through the outer channels of the lower level to outlets 126 and 127 transfer heat horizontally across the vertical walls 114 and 116 to the incoming smoke 123 of primary combustion thereby also preheating the incoming smoke. Incoming smoke is therefore preheated on both sides and overall more efficient heat transfer takes place by this double return arrangement.

Figure 9:
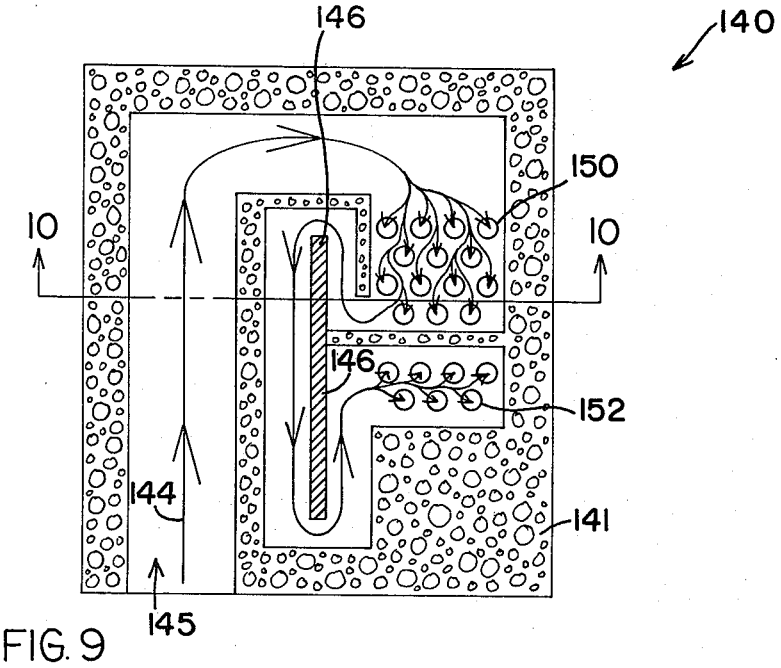
FIG. 9 is a top cross section of another sustained ignition secondary combustion unit according to the present invention with an extended and tortuous heat exchange pathway viewed in the direction of the arrows on line 9—9 of FIG. 10.
Figure 10:
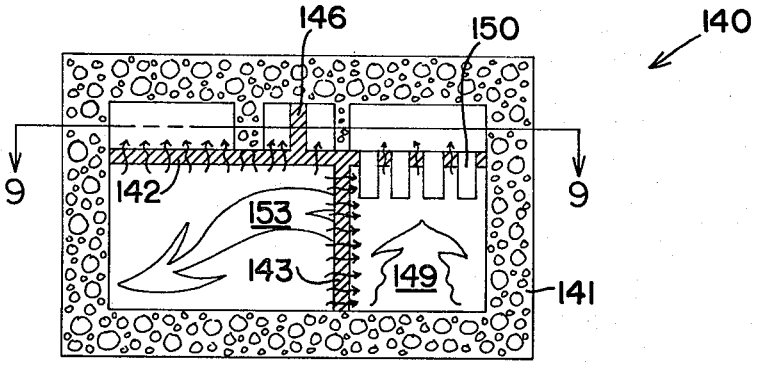
FIG. 10 is a front cross section of the extended heat exchange pathway sustained ignition secondary combustion unit viewed in the direction of the arrows on line 10—10 of FIG. 9.

A sustained ignition secondary combustion unit 140 with extended heat exchange pathways is illustrated in FIGS. 9 and 10. As shown in this arrangement the refractory housing 141 defines an interspace divided by a horizontal divider 142 and vertical divider 143 into upper and lower levels for chambers and side by side tortuous pathways. Secondary air 144 entering through the opening 145 of the secondary combustion unit passes down a refractory lined channel to the first set of igniter tubes 150 located upstream in the secondary air flow and downstream in the smoke channel. The secondary air is then constrained to pass around an upper vertical divider 146 which diverts the secondary air over a prolonged passageway in heat exchange relationship with the end products of secondary combustion in the lower level. This heat exchange occurs across the horizontal divider 142. The secondary air 144 then passes around the separator 146 into a second cluster of igniter tubes 152 down stream in the secondary air flow and upstream in the smoke channel flow in the lower level. Smoke products 149 from primary combustion passing down the right hand channel of the lower level encounter the preheated secondary air establishing the secondary combustion zone. The end products 153 of secondary combustion passes around the end of divider wall 143 returning beneath the horizontal divider 142. With dividers 142 and 143 comprised of heat transfer material heat from the higher temperature products of secondary combustion is transferred to the incoming secondary air 144, as it passes and is constrained to pass in the tortuous channel established by vertical divider 146. Heat is also transferred horizontally across the vertical divider 143 to the incoming primary combustion smoke 149.

It is apparent that in this embodiment of the secondary combustion unit the secondary air constrained to flow in a tortuous passageway over a heat transfer divider separating the secondary air from the hot gaseous end products of secondary combustion. The heat is transferred upward into the secondary air as it follows the prolonged and extended heat exchange pathway for greater preheating of the secondary air prior to passage down the second cluster of igniter tubes 152 upstream in the incoming smoke channel flow. Thus the secondary air first encountered by incoming primary combustion smoke 149 is the higher temperature secondary air subjected to sustain preheating through the longer and tortuous passageway around the separator 146. The end result is: the ability to maintain secondary combustion with cooler smoke entering because the initially contacted secondary air is hotter.

Yet another modification of the secondary combustion unit is illustrated in FIGS. 11A through 11C. In this embodiment a single return sustained ignition secondary combustion unit similar to that described with reference to FIGS. 7A through 7D is provided. Elements similar to that described with reference to FIGS. 7A through 7D are similarly numbered. In the embodiment in FIGS. 11A through 11C however the secondary combustion unit is elongated and a greater length permits installation of a set of smoke preheating tubes 160 in the upstream end of the smoke channel at the inlet side of the smoke and set in insulating horizontal plate portion 161. These smoke preheating tubes 160 extend all the way from the divider 91 to the floor of the housing 93. The smoke preheating tubes 160 differ from the igniter tubes heretofore described because they open only to the secondary air channel and not to the smoke channel. Thus secondary air may find a pathway to the smoke channel only through the interstices of the fibrous walls of the smoke preheating tubes. Shown here the smoke preheating tubes 160 open to the secondary air channel through divider 91 and extend from the divider 91 to the floor of the housing 93. Further the smoke preheating tubes 160 are closed at the housing floor 93 end. Thus the draft established at the outlet 104 produces a pressure differential which causes the secondary air 96 to diffuse or pass through the porous interstices of the walls of the smoke preheating tubes 160. The glowing walls of smoke preheating tubes 160 therefore tend to preheat the smoke products 101 of primary combustion as they enter through the smoke inlet 98 of the secondary combustion unit. Smoke permeates around the smoke preheating tubes which extend entirely across the smoke pathway. The smoke enters the secondary combustion zone 102 where it is ignited by the secondary air igniter tube 100 as described with reference to FIGS. 7A through 7D.

Thus the smoke preheating tubes 160 which extend entirely through the smoke channel from plate 161 to the base of the unit perform a different function from the previous cluster of igniter tubes 100 heretofore described. The smoke preheating tubes 160 extending entirely across the smoke channel upstream from the igniter tubes 100 serve the function of preheating the incoming smoke 101 prior to its entering the secondary combustion zone 102 beneath the cluster of igniter tubes 100. The cluster of igniter tubes permits passage of the secondary air in parallel entirely through the multiplicity of tubes for preheating and distributing the secondary air in a multiplicity of jets for mixing and combusting with the smoke. Furthermore, the smoke preheating tubes 160 can be provided with a source of secondary air separate from the secondary air channel for igniter tubes 100.

Figure 12:
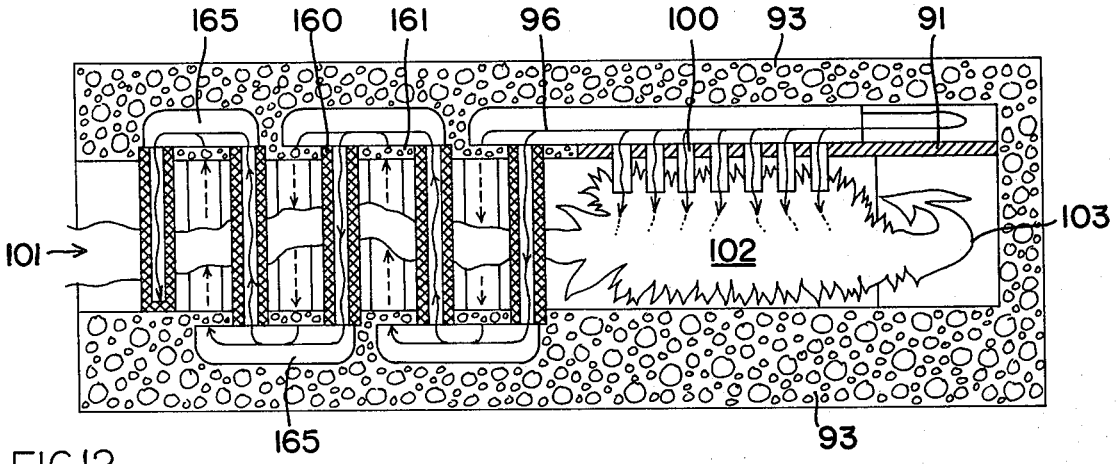
FIG. 12 is a side cross section of a modified single return sustained ignition secondary combustion unit where the air is supplied to the smoke preheating tubes in series by the use of connecting passages.

Yet another modification of the secondary combustion unit is illustrated in FIG. 12. In this embodiment a single return sustained ignition secondary combustion unit similar to that described in FIGS. 11A through 11C is provided. Elements similar to that described with reference to FIGS. 11A through 11C are similarly numbered. In the embodiment in FIG. 12 however the secondary air is supplied to the smoke preheating tubes 160 from the air inlet 97 and secondary air channel to the most downstream two rows of smoke preheating tubes 160. This air then travels in a series route through the remaining pairs of rows of smoke preheating tubes by way of smoke preheating tube air channels 165 to the upstream most row of smoke preheating tubes 160. This series routing of the air through the glowing hot smoke preheating tubes, super preheats the air by the time it reaches the upstream most row. Initial contact is made with smoke products as this upstream most row. The series flow of air through the smoke preheating tubes 160 shown in FIG. 12 contrasts with the parallel flow of secondary air through the preheating tubes 160 of FIGS. 11A through 11C.

Throughout the drawings of the various embodiments of the invention shown in FIGS. 6 through 12 the igniter tubes or smoke preheating tubes have been shown in some cases in simplified form as single wall cylinder elements. This simplification is for purposes of clarity of the drawing only. In each instance the igniter tube or smoke preheating tubes is comprised of a fibrous or porous material such as Kaowool paper rolled into a tubular element having a wall thickness of for example up to a sixteenth of an inch. This finite wall thickness of porous or fibrous or felt material is shown in some of the drawings as double cross hatching where in others for purposes of clarity and simplification only a single line is drawn. However it is intended throughout that the igniter tubes and smoke preheating tubes bear the characteristics in accordance with the present invention of affording a wall of finite thickness with interspaces of interstices in which the secondary air and smoke products may migrate, diffuse and contact for maintaining secondary ignition and a glowing state of the igniter tubes or smoke preheating tubes. By this expedient preheating of secondary air and preheating of smoke products of primary combustion assures secondary combustion throughout the zone below and in the vicinity of the cluster of igniter tubes.

The embodiments of the present invention illustrated in FIGS. 6 through 12 represent variations of the sustained ignition secondary combustion unit which may be retrofitted into existing solid fuel furnaces such as woodburning furnaces or which may be used in association with such woodburning furnaces and primary combustion units. The invention may be used in association with any primary combustion unit which has incomplete combustion, such as oil burners and gas burners. Each secondary combustion unit includes at least an inlet for smoke products of primary combustion and an inlet for secondary air. According to the different variations the secondary air and smoke products travel in adjacent but separated levels or channels preferably in counterflow heat exchange relationship for more efficient exchange of heat between the end products of secondary combustion and the incoming secondary air.

A variety of configurations are described for defining openings in the dividers between the two levels or channels. The openings are defined by porous or fiberlike refractory material preferably in the form of igniter tubes and tubular elements functioning in the manner heretofore described. Such sustained ignition secondary combustion units may be coupled into existing primary combustion sources by coupling the smoke inlet of the unit to the flue outlet of the application or apparatus with which it is used and by coupling the secondary air inlet to an appropriate secondary air damper or control of the application or apparatus with which it is used. Alternatively the secondary combustion units of the present invention may be incorporated integrally into a furnace such as for example a down draft furnace as described with reference to FIGS. 1 through 5.

The sustained ignition secondary combustion unit comprises a secondary air channel and smoke channel as set forth above with openings defined by igniter tubes or tubular elements extending between the channels. The exact orientation and arrangement of the respective levels or channels may vary with one on top or below according to the application. It is also apparent that a variety of materials may be used in constructing the secondary combustion unit generally including a housing at least lined with an insulating refractory material. Furthermore the divider elements are strategically chosen to be heat transferring or heat conducting where heat transfer is a desired objective of the counterflows of secondary air and combustion smoke products.

It is apparent that while the present invention has been described with reference to particular example embodiments, it is intended to cover all variations and equivalents within the scope of the appended claims.

I claim:

1. A sustained ignition secondary combustion unit for the secondary combustion of smoke products from primary fuel burning, either as a built in or retrofitted component of a furnace or stove or as a self contained separate unit comprising:

first level means for conducting secondary air comprising a secondary air inlet and channel;

second level means for conducting smoke products from primary fuel burning comprising a smoke products inlet and channel, secondary combustion zone, and exhaust outlet, said outlet defining the direction of flow of secondary combustion products;

partition means separating the levels comprising a high temperature material, said partition formed with openings communicating between the levels in the area of the secondary combustion zone;

said openings between the levels being substantially surrounded or bounded by a high temperature porous or fiber-like material having surface area portions contacting the secondary air from the first level and smoke products from the second level whereby said porous or fiber-like material may be maintained at a sufficient temperature by contact and combustion of secondary air and smoke products which diffuse into the porous or fiber-like material for sustaining ignition and secondary combustion of smoke products in the second level in the vicinity of the porous or fiber-like material, and for producing high temperature products of secondary combustion in the second level at the secondary combustion zone and downstream in the exhaust outlet direction.

2. The secondary combustion unit of claim 1 further comprising a housing enclosure comprised of insulating high temperature material.

3. The secondary combustion unit of claim 1 wherein said partition means is comprised of heat conducting material for exchange of heat generated by secondary combustion in the second level to the secondary air within said first level thereby preheating said secondary air.

4. The secondary combustion unit of claim 3 wherein said first level and second level are constructed and arranged for counterflow of the secondary air on one side and high temperature products of secondary combustion on the other side of said partition.

5. The secondary combustion unit of claim 4 wherein said secondary air channel comprises multiple or tortuous pathways having said partition means in common with the portions of said second level where high temperature products of secondary combustion occurr, for additional heat exchange and preheating of the secondary air.

6. The secondary combustion unit of claim 5 wherein the portions of said second level where high temperature products of secondary combustion occurr comprise multiple or tortuous pathways corresponding and complementary to the pathways of said secondary air channel for extended heat exchange.

7. The secondary combustion unit of claim 1 further comprising thermal siphon means for enhancing the draft at the outlet of the second level.

8. The secondary combustion unit of claim 1 wherein said openings comprise tube elements defining passageways extending between the levels, said tube elements comprised of a high temperature porous or fiber-like material extending into the secondary combustion zone of the second level whereby said tube element may be maintained at a sufficient temperature, by contact and combustion of secondary air and smoke products diffused into the fiber-like material of the tube elements, for sustaining ignition and secondary combustion of smoke products in the vicinity of said tube elements, said tube elements also having the effect of preheating secondary air as it passes through said defined passageways.

9. The secondary combustion unit of claim 8 wherein said tube elements comprise a ceramic fiber material.

10. The secondary combustion unit of claim 9 wherein said ceramic fiber material comprises Kaowool Paper.

11. The secondary combustion unit of claim 8 wherein said tube elements are formed with at least two different dimensions, tube elements upstream in the direction of travel of the smoke products comprising relatively smaller diameter and longer length for initial contact with the smoke products, and tube elements downstream in the direction of travel of the smoke products comprising relatively larger diameter and shorter length.

12. The secondary combustion unit of claim 11 wherein said upstream tube elements of relatively smaller diameter and longer length are also positioned along the outsides of the secondary combustion zone.

13. The secondary combustion unit of claim 8 or claim 11 wherein said first and second levels are constructed and arranged for counterflow of secondary air and high temperature products of secondary combustion relative to each other on either side of said partition means and wherein said secondary air channel comprises an extended tortuous passageway for delivering some of the secondary air to the tube elements upstream in the direction of travel of smoke products after extended preheating.

14. The secondary combustion unit of claim 1 further comprising after chamber means comprising mixing baffles in a housing of high temperature low thermal conductivity material, coupled to the outlet of said second level.

15. The apparatus of claim 1 further comprising a stove or furnace having a primary combustion chamber and a flue gas exhaust pathway for coupling to a chimney said stove or furnace comprising a sustained ignition secondary combustion unit as defined in claim 1 wherein the second level smoke products inlet is coupled into the flue gas exhaust pathway of said stove or furnace.

16. The apparatus of claim 15 wherein said said stove or furnace comprises a downdraft stove or furnace and wherein the secondary combustion unit is installed below the primary combustion chamber.

17. A stove or furnace as set forth in claim 16 wherein the secondary air inlet channel is bounded by the partition means below and by the primary combustion chamber above.

18. A stove or furnace as set forth in claim 15 further comprising after chamber means coupled at the second level outlet of the secondary combustion unit, said after chamber means comprising mixing baffle means within a high temperature withstanding material housing and having an outlet for coupling to a chimney.

19. The stove or furnace of claim 18 further comprising heat exchanger means coupled to the outlet of said after chamber means.

20. The secondary combustion unit of claim 1 wherein said second level means for conducting smoke products from primary fuel burning doubles back on itself by means of partition means of a heat conducting material, such that heat from ongoing or completed secondary combustion is transferred to the smoke products for preheating said smoke products.

21. The secondary combustion unit of claim 1 further comprising within said second level and upstream of secondary combustion zone a membrane of high-temperature porous or fiber-like material having one surface contacting the secondary air of said first level and the other surface contacting said smoke products of said second level; said porous or fiber-like material of said membrane being maintained at a sufficient temperature to support continuous combustion within said porous or fiber-like material by contact and combustion of said secondary air and said smoke products diffusing into said porous or fiber-like material; said membrane thereby preheating the smoke products passing through the second level before said smoke products reach the secondary combustion zone; said smoke products being preheated by the heat of combustion taking place within said membrane as they pass nearby or contact said membrane.

22. The secondary combustion unit of claim 21 wherein said membrane comprises a plurality of smoke preheating tubes open only to said first level, and extending into or through said second level, said smoke preheating tubes affording a large membrane surface area for contact by said smoke products, while minimizing restriction of flow through said second level.

23. The secondary combustion unit of claim 22 wherein said smoke preheating tubes are arranged in rows, the downstream row or rows arranged for receiving secondary air and further comprising first channel means operatively arranged for conducting said air to the next upstream row or rows of tubes, thus further preheating said air by further contact or proximity with the combustion within said porous or fiber-like material forming the walls of the smoke preheating tubes second channel means operatively arranged for conducting this further preheated air to the next upstream row or rows of smoke preheating tubes thereby supplying super heated air to the most upstream row or rows of smoke preheating tubes first contacted by said smoke products.

24. The secondary combustion unit of claim 21 wherein said tube elements comprise a ceramic fiber material.

25. The secondary combustion unit of claim 22 wherein said tube elements comprise ceramic fiber paper material rolled to form said tube elements.

26. A downdraft stove or furnace for sustained ignition and secondary combustion of the smoke products from primary fuel burning comprising:

a primary combustion chamber having a primary air inlet for burning solid fuels and grate means for supporting the solid fuels and maintaining a bed of hot coals at the base of the primary combustion chamber, said grate means formed with a concave downward configuration defining an elongate tunnel below the primary combustion chamber, said grate formed with downdraft grate openings;

partition means extending along said tunnel dividing the tunnel into upper and lower channels, said upper channel comprising a secondary air channel in heat exchange relationship with the base of the primary combustion chamber but sealed from the grate downdraft openings, said secondary air channel having an inlet for receiving and preheating secondary air, said lower channel comprising a smoke products channel communicating with the primary combustion chamber through the downdraft openings of the grate, said smoke products channel having a flue outlet for establishing a draft through the smoke products channel;

said partition means formed with a plurality of openings between the secondary air channel and the smoke products channel defining in the smoke products channel a secondary combustion zone, said openings between the channels being substantially surrounded or bounded by a high temperature porous or fiber-like material having surface area portions contacting the secondary air from the upper channel and smoke products from the lower channel whereby said porous or fiber-like material may be maintained at a sufficient temperature, by contact and combustion of secondary air and smoke products in the porous or fiber-like material, for sustaining ignition and secondary combustion of smoke products in the secondary combustion zone of the lower channel in the vicinity of the porous or fiber-like material and for producing high temperature products of secondary combustion.

27. The downdraft stove or furnace of claim 26 wherein said openings comprise tube elements defining passageways extending between the levels, said tube elements comprised of a high temperature fiber-like material extending into the secondary combustion zone of the smoke products channel whereby said tubes may be maintained at a sufficient temperature by contact and combustion of secondary air and smoke products in the fiber-like material of the tube elements for sustaining ignition and secondary combustion of smoke products in the vicinity of said tube elements and for preheating secondary air passing through said tube elements.

28. The downdraft stove or furnace of claim 27 wherein said tube elements comprise ceramic fiber paper material rolled to form said tube elements.

29. The downdraft stove or furnace of claim 26 wherein said partition means is comprised of a heat conducting material for heat exchange between the high temperature products of secondary combustion and the secondary air.

30. The downdraft stove or furnace of claim 26 further comprising after chamber means comprising baffle means in a housing of high temperature low thermal conductivity material, coupled to the outlet of said lower channel.

31. The downdraft furnace of claim 30 further comprising heat exchanger means coupled to said after chamber means.

32. The downdraft stove or furnace of claim 27 wherein said tube elements vary in dimension from relatively narrower diameter and longer length to relatively larger diameter and shorter length from upstream to downstream in the direction of travel of the smoke products for initial contact of the relatively narrower diameter tube elements with the smoke products.

* * * * *